US005971814A

United States Patent [19]

Boyd et al.

[11] Patent Number: 5,971,814

[45] Date of Patent: Oct. 26, 1999

[54] LAMP SOCKET

[75] Inventors: Steven M. Boyd, Warren; Michael J. Bonavita, Russell; Ronald E. Thomas, Warren; Richard P. Walker, Saegertown, all of Pa.

[73] Assignee: Osram Sylvania Inc., Danvers, Mass.

[21] Appl. No.: 09/149,415

[22] Filed: Sep. 8, 1998

[51] Int. Cl.[6] ..... H01R 17/00

[52] U.S. Cl. ..... 439/699.2; 439/356

[58] Field of Search ..... 439/699.2, 356

[56] References Cited

U.S. PATENT DOCUMENTS 5,800,183 9/1998 Paul et al. ..... 439/699.2
5,895,283 4/1999 Takanashi ..... 439/699.2
5,895,295 4/1999 Harada ..... 439/699.2

*Primary Examiner*—Michael L. Gellner
*Assistant Examiner*—Antoine Ngandjui
*Attorney, Agent, or Firm*—William H. McNeill

[57] ABSTRACT

A lamp socket is provided that includes slidably engaging body and housing components. Resilient retention members are attached within the body component to grasp the base of a wedge base lamp to attach the lamp to the body component. Contacts extend into the body component to engage lead wires of the lamp. Such contacts extend out of the body component and through respective apertures in the housing component for electrical and mechanical attachment to a mating connector. The contacts are held in place relative to the body component by being inserted into body openings within the body component structured and arranged to hold the contacts in place.

24 Claims, 11 Drawing Sheets

LAMP SOCKET

TECHNICAL FIELD

The present invention relates to a lamp socket, and more particularly to a lamp socket for a wedge base lamp used in a lighting module of a motor vehicle. For example, the lamp socket of the present invention is particularly useful in front and rear automobile directional and safety lighting applications.

BACKGROUND ART

Existing lamp sockets such as, for example, lamp sockets for use with wedge base lamps, utilize dual retention beams that are molded as part of a plastic socket insulator. The retention of the lamp within such a lamp socket is typically limited to retention by such beams. Lamps retained by dual retention beams molded as part of the socket insulator incur a significant amount of lateral lamp movement. Lateral lamp movement adversely affects the contact interface between the lamp lead wires and the contacts of the lamp socket and provides a common point of lamp failure. Existing lamp socket designs typically utilize up to three plastic molded components and seven stamped metal components that require sub-assemblies and secondary assembly operations. The fabrication of such lamp sockets is costly.

DISCLOSURE OF THE INVENTION

It is an object of the present invention to provide an improved lamp socket.

It is another object of the present invention to provide a lamp socket that is less costly to fabricate than those heretofore provided.

Another object of the present invention is to provide a lamp socket that provides improved lamp performance and life expectancy.

Yet another object of the present invention is to provide a lamp socket that provides vibration resistance to a lamp retained therein.

A further object of the present invention is to provide a lamp socket that facilitates lamp positioning therein.

Another object of the present invention is to provide a lamp socket that provides improved electrical conductivity between lamp lead wires and lamp socket contacts.

It is a further object of the present invention to provide a lamp socket having improved life expectancy.

Yet another object is to provide a lamp socket the assembly of that provides a very reliable method of joining plastic and metal components.

This invention achieves these and other objects, in one aspect of the invention, by providing a lamp socket that comprises first and second slidably engaging components including a body component and a housing component. The body component includes a body cavity that includes opposing surfaces that include opposing angled ledges. The body component further comprises a plurality of contact cavities that extend therethrough. The housing component includes a housing cavity matable with the body component. The housing component includes at least one contact aperture extending therethrough. First and second resilient retention members are provided that are structured and arranged for insertion into the body cavity to slidably engage respective of the opposing angled ledges and to retain a base of a lamp therein. A plurality of contacts is provided. Each contact is structured and arranged for insertion into a respective contact cavity to slidably engage the contact cavity. Each contact includes a first end adapted to engage a lead wire of a lamp and an opposite second end adapted to extend through a contact aperture.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
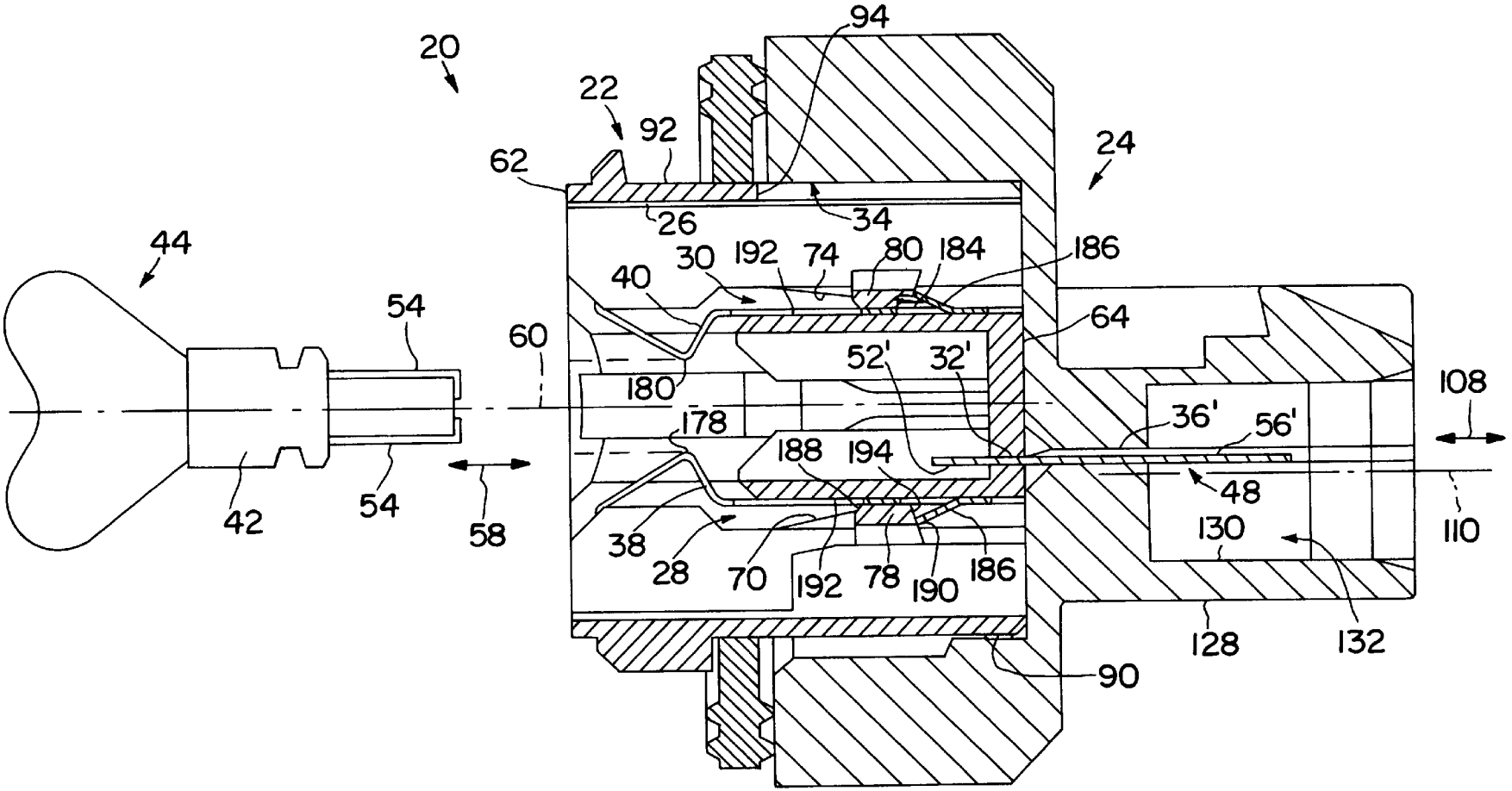
FIG. 1 is a cross sectional elevational view of one embodiment of the lamp socket of the present invention illustrated as an exploded view including a lamp.
Figure 2:
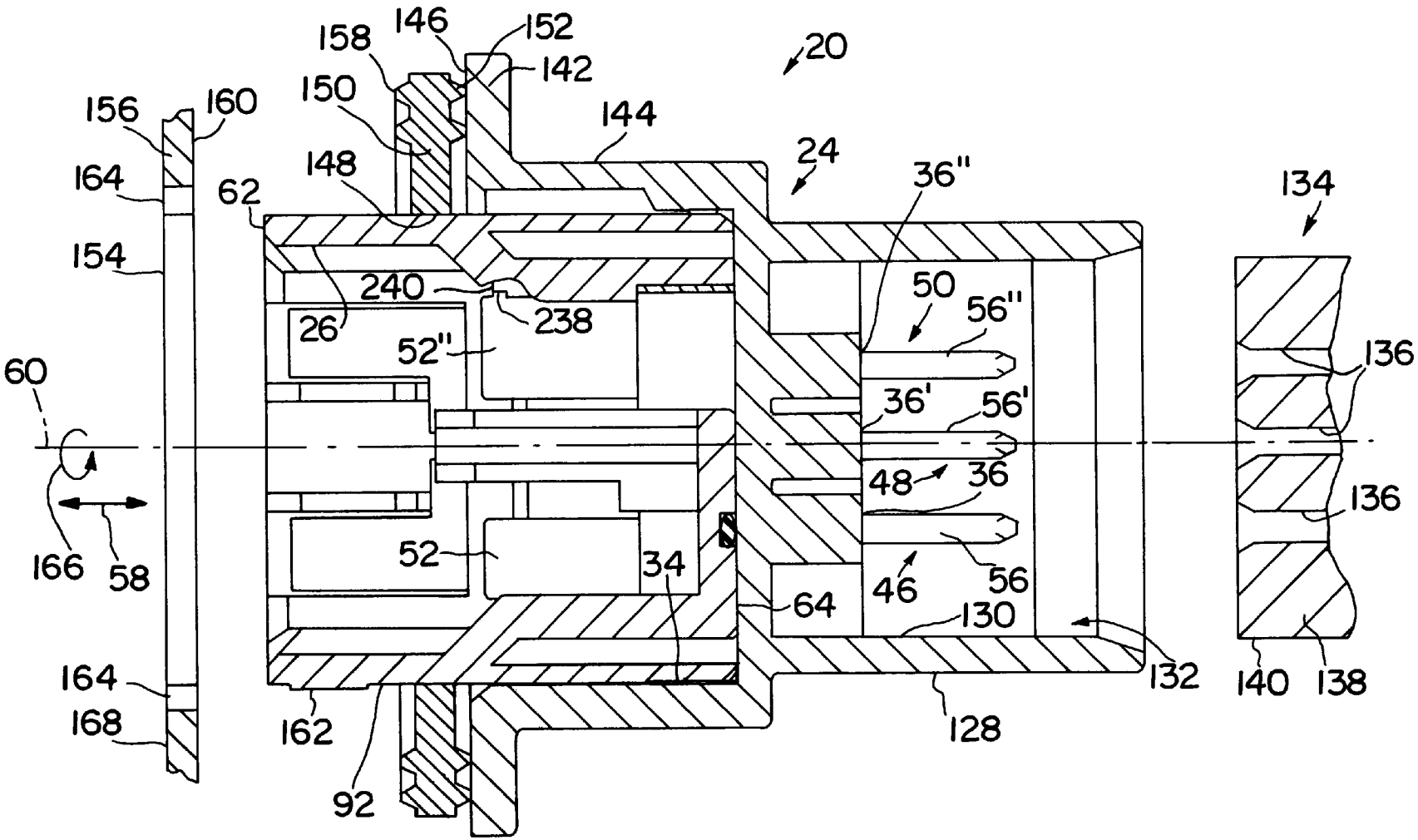
FIG. 2 is a cross sectional plan view of the embodiment of FIG. 1 illustrated as an exploded view without a lamp but including a support member and a mating connector.

The embodiment of this invention that is illustrated in the drawings is particularly suited for achieving the objects of this invention. Referring now to the drawings with greater particularity, FIGS. 1 and 2 illustrate a lamp socket 20 comprised of a two piece insulator that is in the form of first and second slidably engaging components including a body component 22 and a housing component 24. As will be apparent herein, the two piece insulator simplifies design and assembly of the lamp socket. The body component 22 includes a body cavity 26 that includes opposing surfaces 28 and 30 forming opposing angled ledges. The body component 22 comprises a plurality of contact cavities 32, 32', 32" that extend therethrough. Housing component 24 includes a housing cavity 34 that is matable with the body component 22. Housing component 24 also includes a plurality of contact apertures 36, 36', 36" that extend therethrough. When the body component 22 and housing component 24 are engaged, the contact cavities 32, 32' 32" are generally in alignment with the contact apertures 36, 36', 36".

The lamp socket 20 includes a first resilient retention member 38 and an opposite second resilient retention member 40. In a preferred embodiment, the resilient retention members are metal although other materials may be used.

Retention members 38 and 40 are structured and arranged for insertion into the body cavity 26 to (1) slidably engage opposing angled ledges 28 and 30, respectively, and (2) retain a wedge-like base 42 of a lamp 44 such as a conventional S8 wedge base lamp.

The lamp socket 20 includes a plurality of contacts 46, 48 and 50 structured and arranged for insertion into a respective contact cavity 32, 32', 32" to slidably engage the contact cavity. Each contact 46, 48, 50 includes an end 52, 52', 52", respectively, facing the body front 62 and adapted to engage a respective lead wire 54 of lamp 44, and an opposite end 56, 56', 56", respectively, extending out of the body component 22 at body rear 64 and adapted to be connected to a mating connector.

Figure 3:
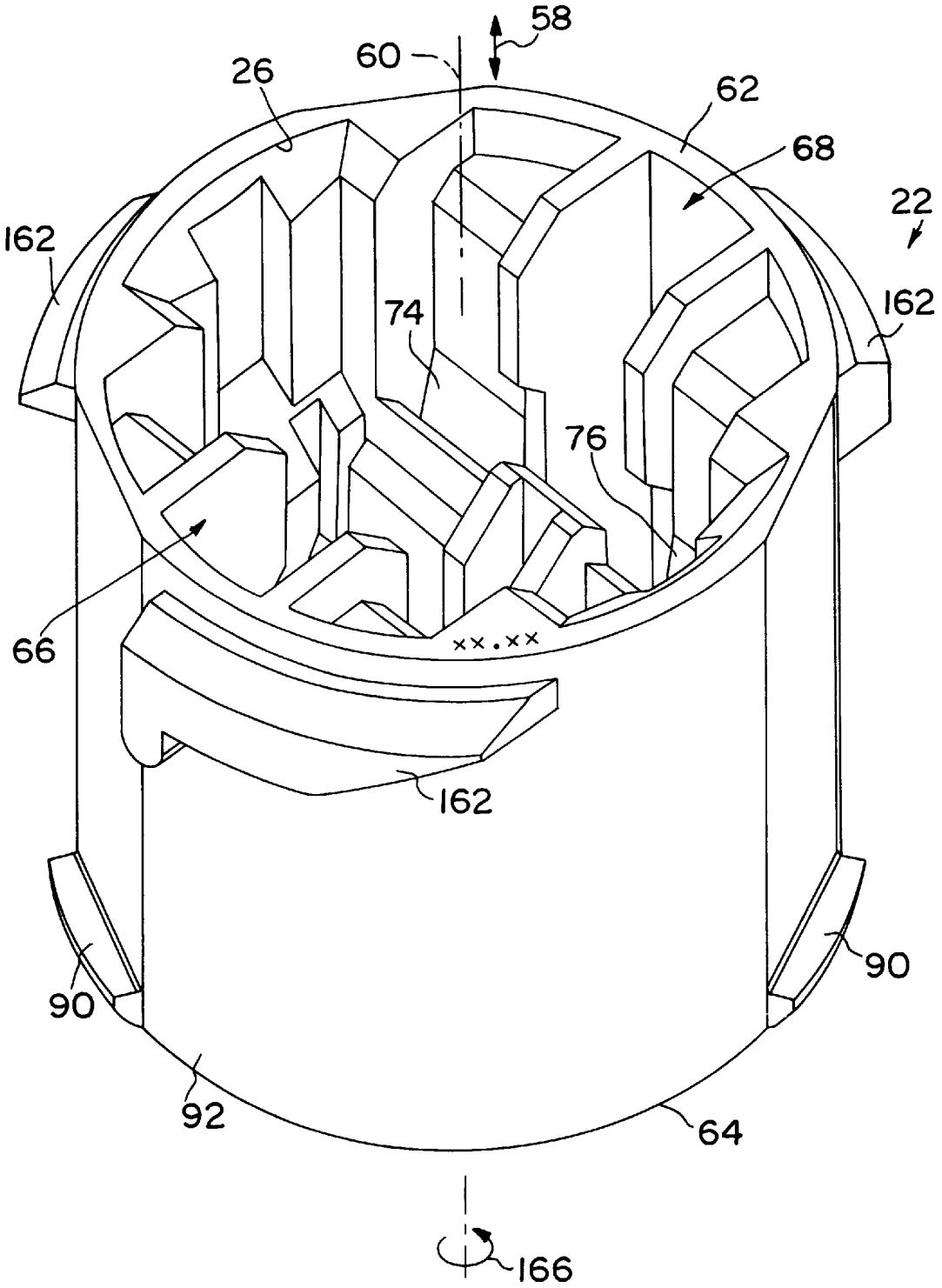
FIG. 3 is a perspective front view of one embodiment of a body component of the present invention.
Figure 4:
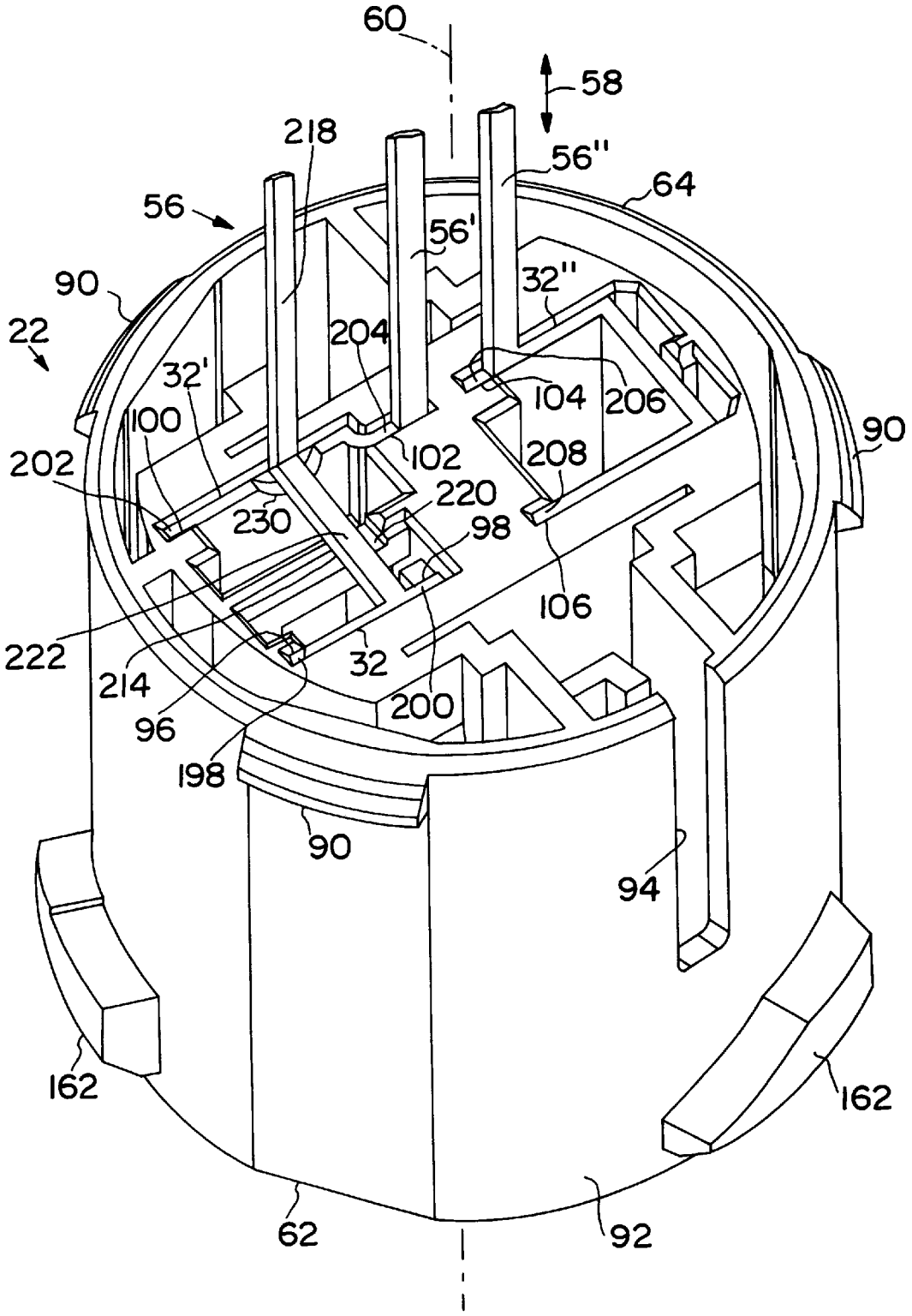
FIG. 4 is a perspective rear view of the body component illustrated in FIG. 3.
Figure 5:
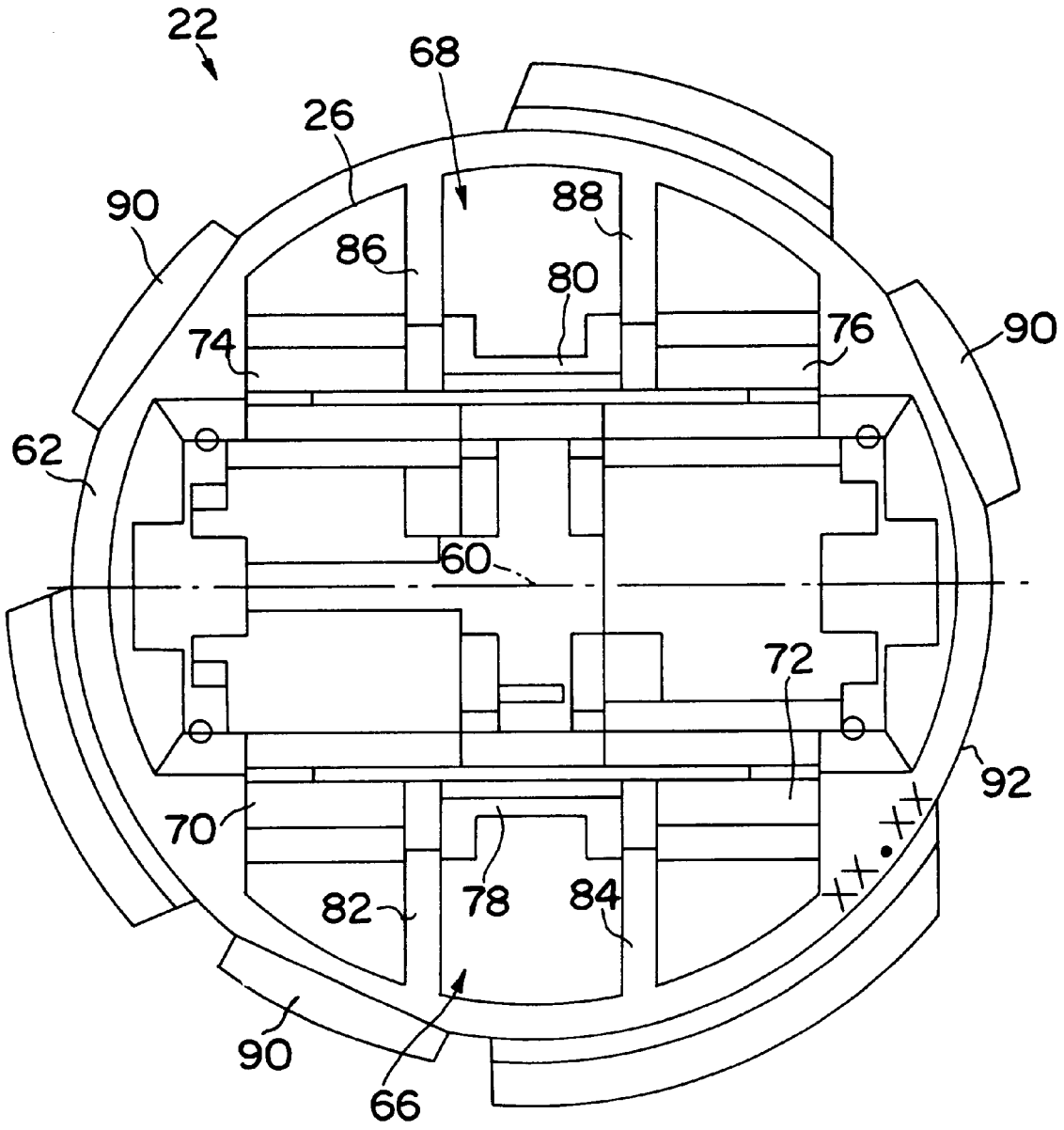
FIG. 5 is a front view of the body component illustrated in FIG. 3.

Details of the embodiment of the body component of the present invention illustrated in FIGS. 1 and 2 are further illustrated in FIGS. 3 to 5. In a preferred embodiment, body component 22 is a molded plastic component. With reference to FIGS. 3 and 4, the body component 22 extends in direction 58 of axis 60 from a body front 62 to a body rear 64. With reference to FIGS. 3 and 5, the body cavity 26 includes a first body opening 66 and an opposite second body opening 68 that extend into the body component 22 from the front 62 towards the rear 64. Body openings 66, 68 include the opposing surfaces 28 and 30 in the form of a first pair of angled ledges 70, 72 and an opposite pair of angled ledges 74, 76, respectively. The pairs of ledges 70, 72 and 74, 76 extend in direction 58 of axis 60.

The body cavity of the body component of the present invention may comprise oppositely disposed latch members that engage the first and second resilient retention members as explained hereinafter. To this end, the body component of the present invention may include a first latch member within the body cavity and located between the first pair of angled ledges, and a second latch member within the body cavity and located between the second pair of angled ledges. For example, in the embodiment illustrated in FIGS. 1 to 5, the body component 22 includes a latch member 78 within body opening 66 located between the pair of angle ledges 70 and 72, and an opposite latch member 80 within body opening 68 located between the pair of angle ledges 74 and 76. Latch members 78 and 80 are in the form of ribs that extend between body component wall members 82, 84 and 86, 88, respectively.

The body component of the present invention includes at least one locking member that engages the housing component as described hereinafter. For example, in the embodiment of FIGS. 1 to 5, the body component 22 includes three equally spaced locking members. In this embodiment, the locking members are in the form of flexible camming members 90 each of that extend from an outer wall 92 of the body component 22. Camming members 90 may be incorporated into the molding design for the body component 22.

The body component of the present invention includes an alignment member to align the body component with the housing component when the body component is inserted into the housing cavity as described hereinafter. For example, in the embodiment of FIGS. 1 to 5, the body component 22 includes an alignment member in the form of an elongated opening 94 that extends in the outer wall 92 in the direction 58 of axis 60 from the body rear 64 towards the body front 62. Although not necessary, in the embodiment illustrated in FIGS. 1 to 5 the elongated opening 94 extends completely through the outer wall 92.

Each contact cavity of the body component of the present invention includes at least one slot into that a respective contact slides, the interrelationship between the slot and contact serving to hold the contact firmly in place as described hereinafter. For example, with reference to FIG. 4, cavity 32 includes slots 96, 98; cavity 32', includes slots 100, 102; and cavity 32" includes opposite slots 104, 106. In the embodiment illustrated in FIGS. 1 to 5, the cavities 32, 32', 32" and the slots extend in the direction 58 of axis 60 from the body rear 64 towards the body front 62.

Figure 6:
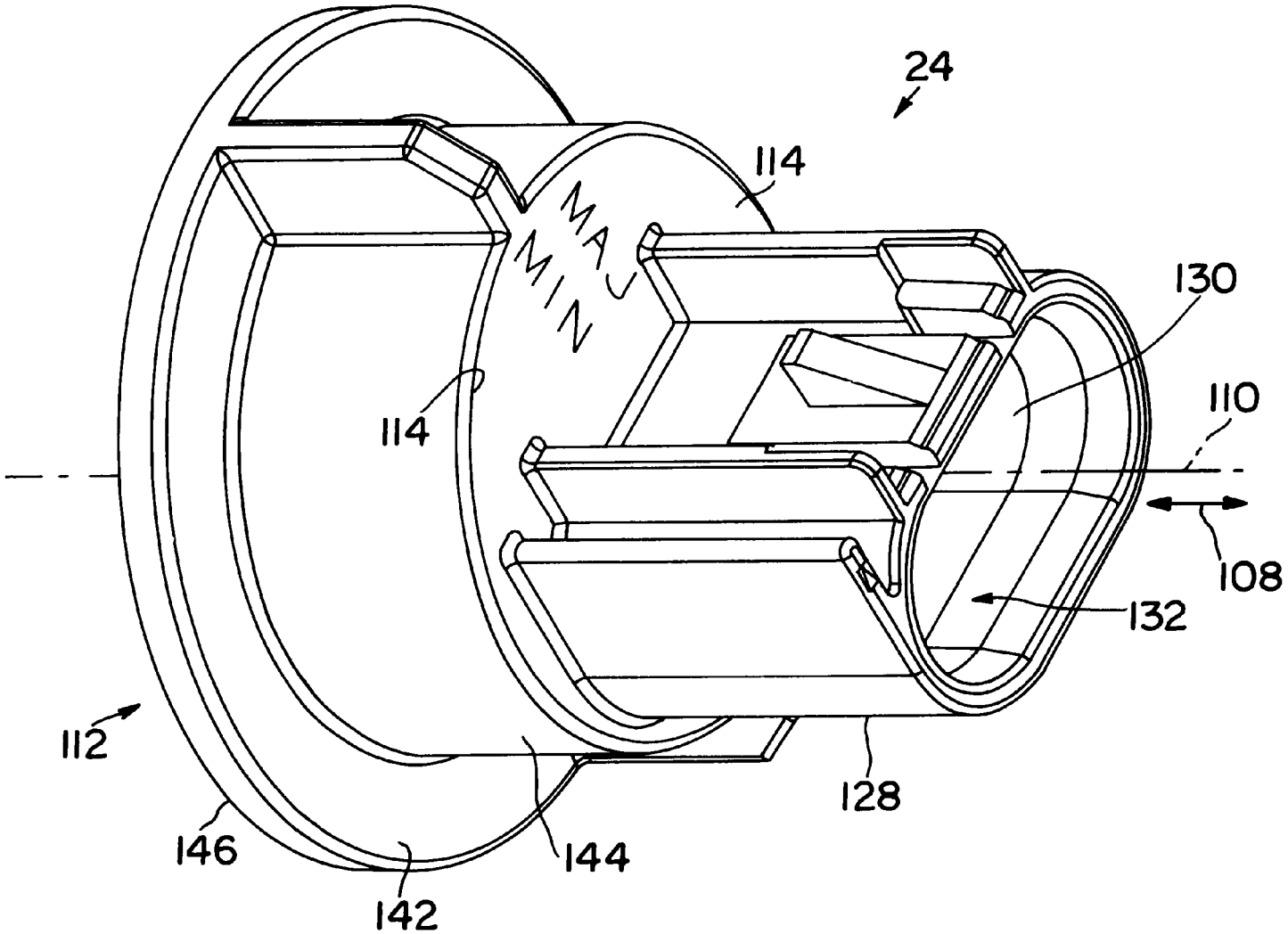
FIG. 6 is a perspective rear view of one embodiment of a housing component of the present invention.
Figure 7:
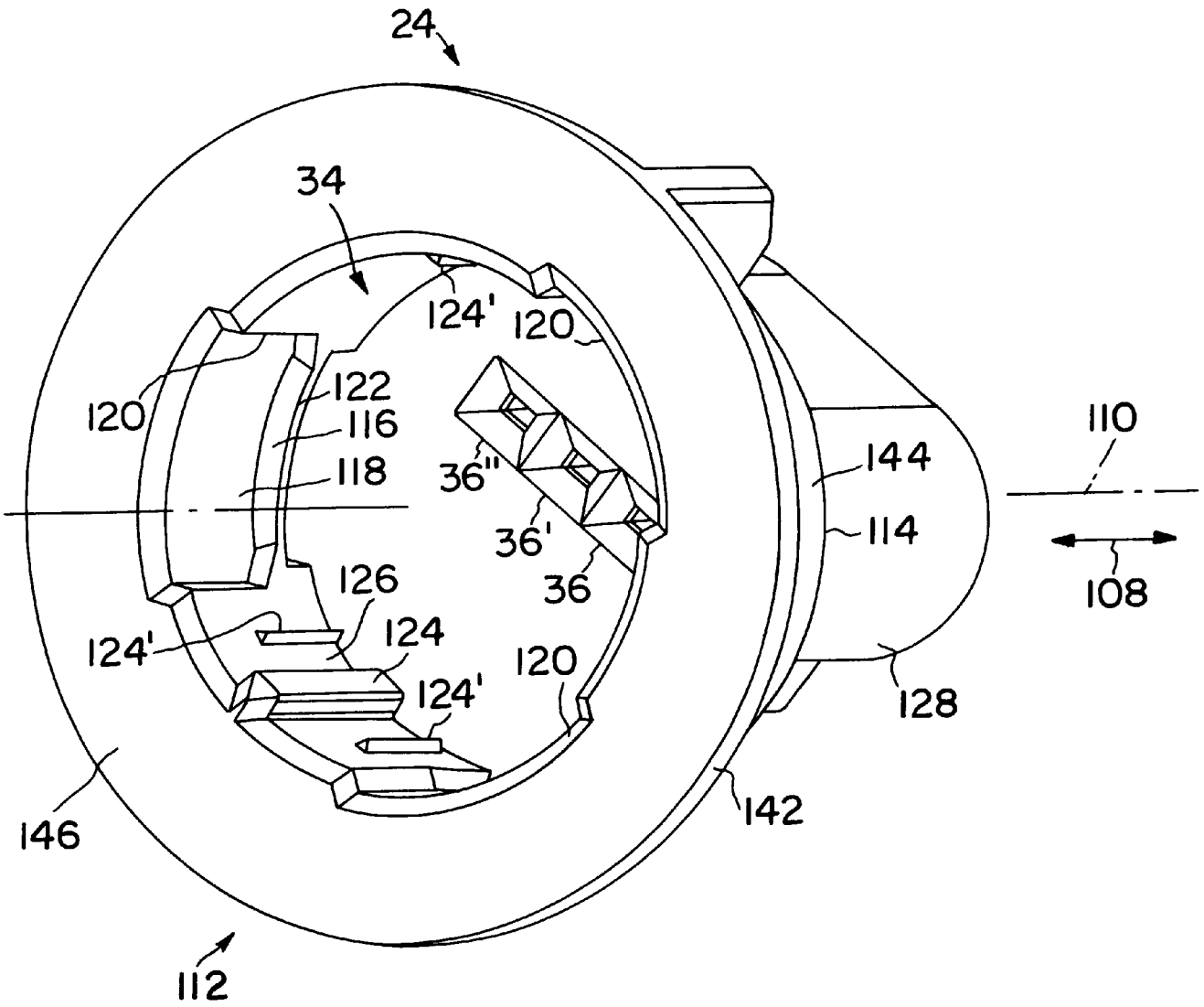
FIG. 7 is a perspective front view of the housing component of FIG. 6.

Details of the embodiment of the housing component of the present invention illustrated in FIGS. 1 and 2 are further illustrated in FIGS. 6 and 7. In a preferred embodiment, housing component 24 is a molded plastic component. Housing component 24 extends in direction 108 of an axis 110 from a housing front 112 to a housing rear 114. In the embodiment illustrated in FIGS. 6 and 7, there are three contact apertures 36, 36', 36" through that extend a respective contact 46, 48, 50 when the body component 22 is attached to the housing component 24. Apertures 36, 36', 36" extend through the housing component 24 from the rear 114 to the housing cavity 34. With reference to FIGS. 1 and 2, the body component 22 slidably engages the housing component 24, the rear 64 of the body component extending into the housing cavity 34 and the cavities 32, 32' 32" generally aligning with apertures 36, 36', 36".

The housing component of the present invention includes at least one mating locking member that engages the body component. For example, in the embodiment of FIGS. 6 and 7, the housing component 24 includes three equally spaced mating locking members. In this embodiment, the mating locking members are in the form of mating camming members 116 each of that extend from an inner surface 118 of a channel 120. Each mating camming member 116 is positioned at the base of a respective channel 120 that extends in direction 108 from the housing front 112 towards the housing rear 114 terminating at a locking wall 122. In assembling the body component 22 and housing component 24, each flexible camming member 90 of the body component is aligned with a respective channel 120, and the body rear 64 is inserted into cavity 34 of the housing component. During such insertion, each mating camming member 116 engages a respective camming member 90 deflecting each camming member 90 towards axis 60 until each camming member 90 reaches the inner end of the mating camming member 116 and snaps into engagement with a respective locking wall 122 to thereby attach the body component to the housing component. In the embodiment illustrated in FIG. 7, although only one mating camming member 116 and wall 122 is visible, there are three equally spaced mating camming members 116 and walls 122, a camming member and wall at the base of each channel 120.

The housing component of the present invention includes a mating alignment member to align the housing component with the body component when the body component is inserted into the housing cavity. For example, in the embodiment of FIGS. 6 and 7 the housing component 24 includes a mating alignment member in the form of an elongated rib 124 that extends from an inner surface 126 of the housing component in direction 108 of axis 110 from the housing front 112 towards the housing rear 114. When the body rear 64 of the body component 22 is inserted into the housing cavity 34, the elongated rib 124 engages the elongated opening 94 of the body component, and the body component is thereby guided into the housing cavity as the rib slides along the elongated opening. The housing component 24 may also include a plurality of elongated crush ribs 124' that extend from inner surface 126 in direction 108. Crush ribs 124' are adapted to engage outer surface 92 of the body component 22 and provide interference between the housing and body components to assure a rattle free assembly.

Figure 10:
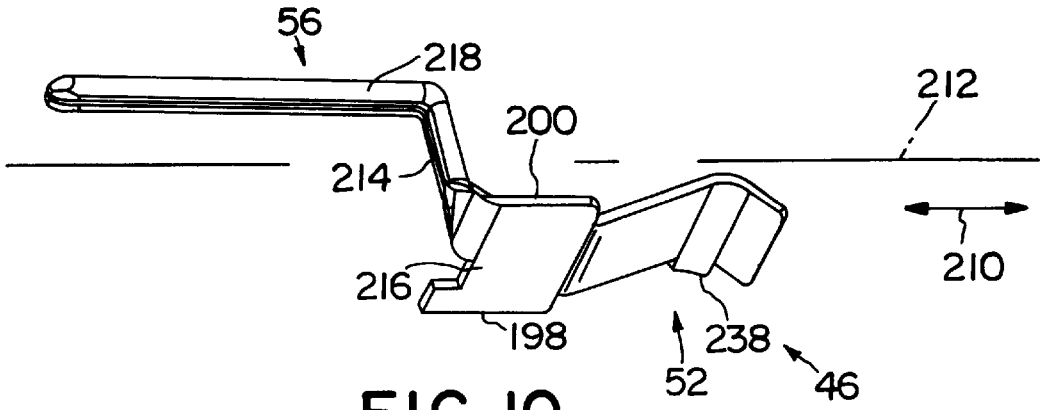
FIGS. 10 to 12 are perspective views of the embodiments of the contacts illustrated in FIG. 2.
Figure 11:
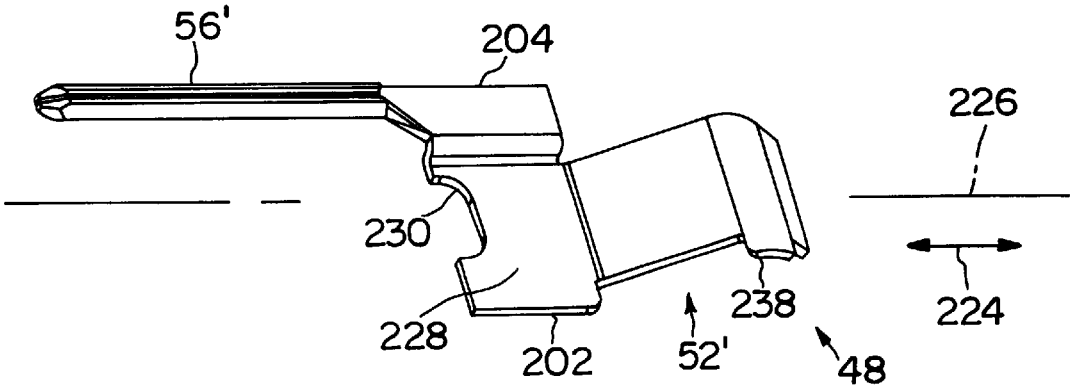
Figure 12:
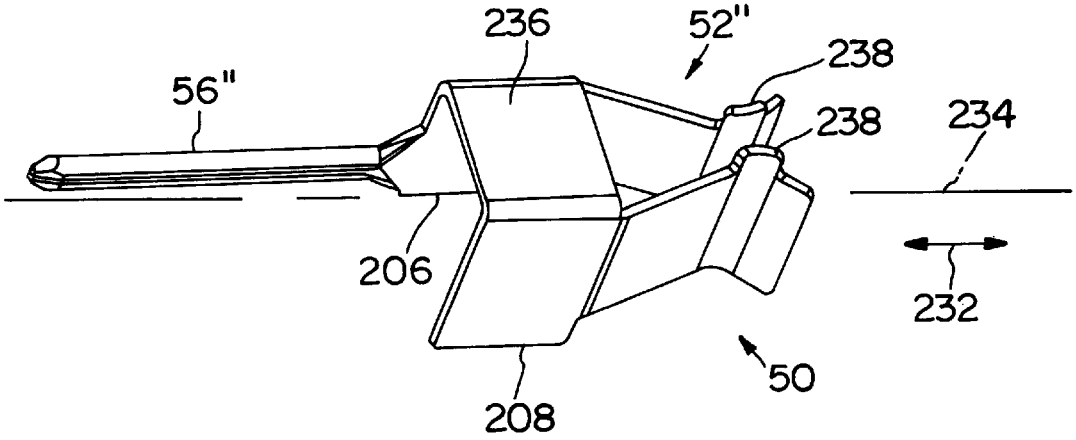

In the embodiment illustrated in FIGS. 6 and 7, the housing component comprises a contact shroud that protects the ends 56, 56', 56" of contacts 46, 48 and 50 that extend from contact apertures 36, 36', 36" at the housing rear 114. In particular, housing component 24 comprises a contact shroud 128 that extends away from the housing front 112 in the direction 108 of axis 110 at the housing rear 114. Shroud 128 comprises a seamless inner surface 130 surrounding a shroud cavity 132 into that the contact ends 56, 56', 56" extend as illustrated in FIGS. 1 and 2. The seamless inner surface 130 is structured and arranged for sealing engagement to provide a moisture seal with a mating connector 134. In particular, the mating connector includes mating contacts 136 that may be electrically and mechanically connected to respective contacts 46, 48 and 50 in a conventional manner, and a connector housing 138 having an outer surface 140 that may be inserted into the shroud cavity 132 and firmly engage the seamless inner surface 130 to effect the desired seal. Outer surface 140 may be provided with a silicone perimeter seal (not shown). In a preferred embodiment, the end 56, 56', 56" of each contact 46, 48, 50, respectively, may have a thickness that is greater than the thickness of the remaining portion of each contact to facilitate insertion of the end 56, 56', 56" into a respective mating contact 136. For example, ends 56, 56', 56" may have a double thickness as illustrated in FIGS. 10 to 12 described hereinafter. In this embodiment, the ends 52, 52', 52" that contact the lead wires 54 of the lamp 44 have a single material thickness.

The housing front of the housing component of the embodiment of the present invention illustrated in the drawings comprises a flange and a moisture flange seal to seal the front of the lamp socket against a supporting member to that the lamp socket may be attached. Such a supporting member may be a lighting module of a motor vehicle. For example, in the embodiment of FIGS. 1, 2, 6 and 7, the housing component 24 includes a flange 142 that surrounds the outer periphery 144 of the housing component. Flange 142 includes a seamless surface 146. With reference to FIG. 2, the body rear 64 of the body component 22 is inserted into an opening 148 of an annular seal 150. In a preferred embodiment, annular seal 150 is a thermoplastic elastomer although other materials may be used. The body rear 64 is then inserted into the housing cavity 34 of the housing component 24, and the seal 150 is moved so that its surface 152 engages the seamless surface 146 of the flange 142 of the housing component. The body front 62 may then be inserted into opening 154 of the supporting member 156, to that the lamp socket 20 is to be fastened, until the seal surface 158 engages the surface 160 of the supporting member. Surface 160 may be the rear surface of a lighting module. During insertion of the body component 22 into the opening 154, detents 162 extending from surface 92 of the body component are aligned with mating recesses 164 to permit such insertion. When insertion is completed, the lamp socket 20 may be rotated in direction 166 until the detents 162 engage surface 168 of the support member 156 to hold the lamp socket in place relative to the support member.

The first and second resilient retention members of the present invention may each comprise a pair of retention beams joined together by a common cross arm, each beam comprising a bearing surface that engages a respective angled ledge of the body cavity of the body component. In such embodiment, each pair of retention beams extend into a respective body cavity and include a bearing surface and a mating latch member that slidably engage a pair of body housing angled ledges and a body housing latch member, respectively. The two pairs of retention beams are structured and arranged to cooperate with each other to retain a base of a lamp therebetween when the lamp is inserted into the body component at the body front as described hereinafter.

Figure 8:
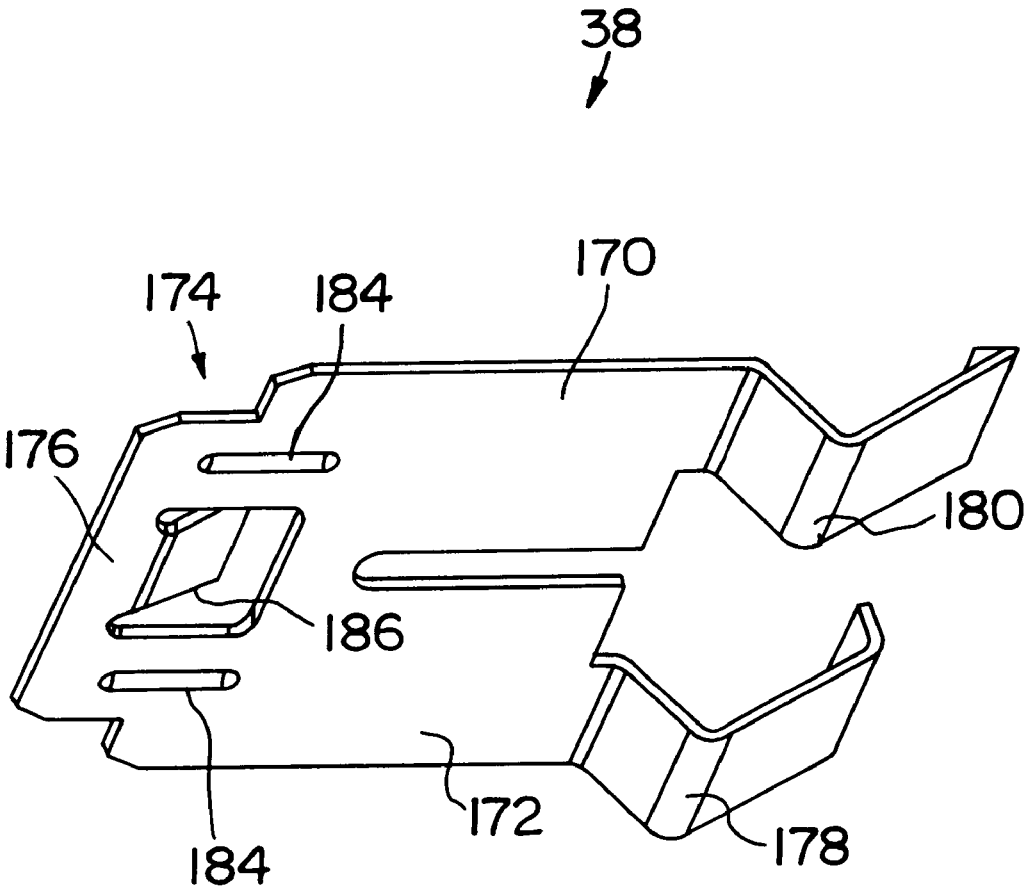
FIG. 8 is a perspective bottom view of one embodiment of a resilient retention member of the present invention.

FIG. 8 is illustrative of one type of resilient retention member of the present invention that comprises a pair of retention beams. FIG. 8 illustrates resilient retention member 38. Retention member 40 is identical thereto. Retention member 38 is in the form of a pair of retention beams represented by a first leg 170 and a second leg 172 joined together at one end 174 by a common cross bar 176. The provision of a common cross bar 176 simplifies the stamping and assembly process and adds strength to the retention members 38,40. Legs 170 and 172 extend from the cross bar 176 to respective distal ends. The end 174 provides a bearing surface that engages a pair of body housing angled ledges when the end 174 is inserted into a respective body cavity. When the two pairs of resilient retention members 38, 40 are inserted into respective body openings 66 and 68, the legs 170, 172 of each retention beam will extend from a cross bar 176 towards the body front 62. In such an arrangement, the respective lamp base retaining portions 178, 180 at the distal ends of opposite retention beams 38, 40 will face each other as illustrated in FIG. 1. The resiliency of the legs 170, 172 and spacing between the opposing retaining portions 178, 180 will be structured and arranged to permit the wedge-type base 42 of the lamp 44 to be inserted between and grasped and retained in place by the opposing retaining portions. The use of opposing resilient retention members 38, 40 facilitates positioning a lamp within the lamp socket 20 and improves lamp retention and stability in the lamp socket in that the wedge-like base 42 is contained at each of four comers of the base by a respective retaining portion 178, 180. The use of the metal spring-like retention members 38, 40 improves electrical conductivity and provides a reduction in lamp insertion force, yet maintains lamp withdrawal force to provide satisfactory containment of the wedge-type base 42. Positioning, retention and stability of the wedge-type base 42 may be further facilitated by configuring the portions of the body cavity 26 into that the wedge-type base is inserted to substantially conform to the configuration of the wedge-type base without adversely affecting insertion and withdrawal tolerances. The use of metal retention members 38, 40 provides a superior resistance to creep and stress relaxation relative to the plastic beams molded as part of the socket insulator in lamp sockets used heretofore thereby providing continued satisfactory grasping of the lamp base. Lamp and lamp socket life expectancy and performance are improved accordingly notwithstanding temperature and vibration cycling that is present in some environments such as a motor vehicle.

Figure 9:
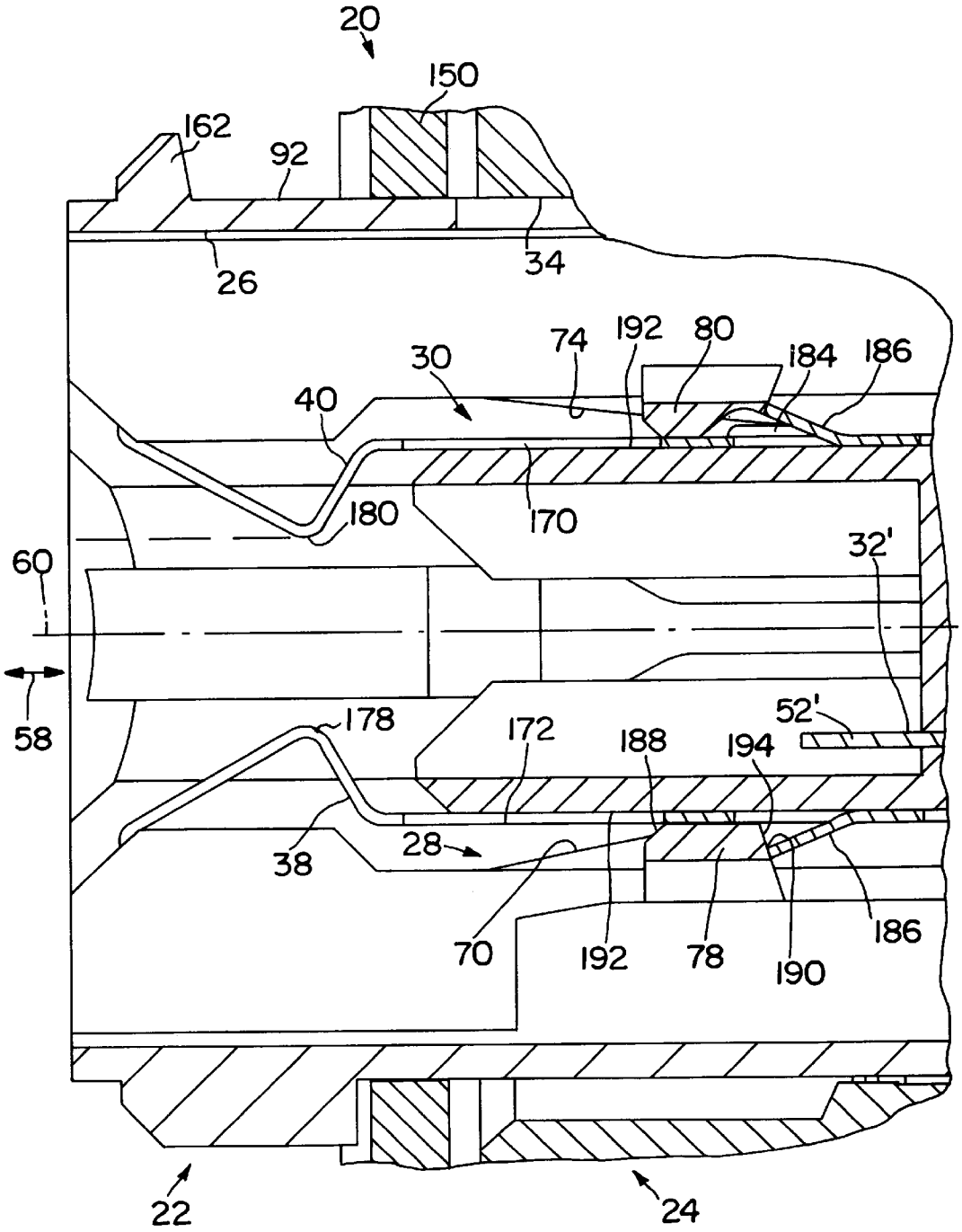
FIG. 9 is an enlarged view of a portion of the lamp socket illustrated in FIG. 1.

As noted above, in the embodiment illustrated in FIG. 8 the end 174 of the retention beam 38 provides a bearing surface that engages a pair of body housing angled ledges when the end 174 is inserted into a respective body cavity. To this end, at end 174 each leg 170 and 172 may comprise a protuberance 184 that engages a respective angled ledge of the pair of angled ledges. FIG. 8 illustrates the bottom of protuberances 184 of the retention beam 38. FIG. 9 illustrates a protuberance 184 engaging an angled ledge 74 of the body component 22.

In the embodiment illustrated in FIG. 8, the common cross bar 176 of each retention member 38, 40 includes a resilient mating latch member 186 positioned between the legs 170, 172. Each mating latch member 186 engages a respective body housing latch member 78, 80 when end 174 of each retention member is inserted into the body cavity to lock the retention member to the body component. For example, FIG. 9 illustrates the retention members 38, 40 attached to the body component 22 within the body cavity 26 by the engagement of latch members 78, 80 with a respective mating latch member 186. In such embodiment, the latch members 78, 80 provide a camming surface 188 and the mating latch members 186 of retention members 38, 40 provide a mating camming surface 190.

When assembling the retention beams 38, 40 with the body component 22, the end 174 of each resilient retention member is inserted into a respective body opening 66, 68 in direction 58 of axis 60. During such insertion, the protuberances 184 engage a respective angled ledge 70, 72 and 74, 76 that urges the retention members 38, 40 toward the axis 60 and downward against respective opposing body housing surfaces 192 as best illustrated in FIG. 9. Engagement between the protuberances 184 and respective angled ledges 70, 72 and 74,76 holds the retention members 38,40 in place against a respective surface 192 and prevents any vertical movement thereof. Also, during insertion each mating camming surface 190 of each resilient mating latch member 186 is cammed by a camming surface 188 of a respective latch member 78, 80 until each mating camming surface 190 snaps behind a respective retaining wall 194 of a respective latch member 78, 80 to lock the retention members 38, 40 in place. This latching mechanism ensures that the retention members 38,40 are always properly seated and incur a constant downward pressure caused by the engagement of the angled ledges with the protuberances 184.

Without limitation, FIGS. 10, 11 and 12 are illustrative of the contacts 46, 48 and 50, respectively, of the lamp socket illustrated in FIGS. 1 and 2. In the embodiment illustrated in FIGS. 1 and 2, each contact 46, 48, 50 includes a region between its respective ends 52, 52', 52" and 56, 56', 56" that includes at least one extension that extends into and slidably engages a respective slot in a respective contact cavity 32, 32', 32". For example, with reference to FIGS. 1, 2 and 10, contact 46 includes an end 52 structured and arranged to engage a lead wire 54 of lamp 44 and an end 56 structured and arranged to be connected to a mating connector 134. Contact 46 further includes opposite sideway extensions 198, 200 between ends 52 and 56. With reference to FIG. 4, sideway extensions 198, 200 are structured and arranged to slidably engage and extend into a respective slot 96,98 of cavity 32. Similarly, with reference to FIG. 11, contact 48 includes a similar end 52' and end 56'. Contact 48 further includes opposite sideway extensions 202, 204 between ends 52' and 56'. With reference to FIG. 4, sideway extensions 202, 204 are structured and arranged to slidably engage and extend into a respective slot 100, 102 of cavity 32'. With reference to FIG. 12, contact 50 includes a similar end 52" and end 56". Contact 50 further includes opposite sideway extensions 206, 208 between ends 52" and 56". With reference to FIG. 4, sideway extensions 206, 208 engage respective slots 104, 106 of cavity 32". Contacts 46, 48 and 50 are inserted into body component 22 by inserting respective ends 52, 52', 52" of contacts 46, 48, 50 into contact cavities 32, 32', 32" at the body rear 64 in direction 58 of axis 60. During such insertion, the sideway extensions engage the walls of respective slots, and such engagement serves to hold the contacts within the contact cavities after the contacts have been fully inserted therein. To further facilitate binding each contact in a respective contact cavity, each sideway extension may be preloaded such that the preloaded extension is urged against a respective wall of a respective slot thereby effecting a reaction force through the contact to hold the contact in place. It is believed that the combination of the geometry of the retention members 38,40 and the preloading feature will provide a tighter range of normal force values than conventional designs thereby more firmly holding the contacts in place in the body component 22.

It will be noted that ends 56, 56', 56" of contacts 46, 48 and 50 have a thickness that is greater than the thickness of the remaining portion of the contacts. As noted herein, such increased thickness facilitates insertion of the ends 56, 56', 56" into respective mating contacts 136 and reduces the tendency of such ends to bend during insertion or when otherwise engaged.

Each contact 46, 48, 50 provides a single piece contact that provides an electrical interface between respective lamp lead wires 54 of lamp 44 and respective contacts 136 of the mating connector 134. Contacts 46, 48, 50 are configured as illustrated in FIGS. 10 to 12, respectively, to provide electrical conductivity without incurring electrical contact with each other. The configuration of the contacts 46, 48, 50 and their relationship to each other, is best understood by reference to FIGS. 4 and 10 to 12.

FIG. 10 illustrates contact 46 that extends in direction 210 of an axis 212 from end 52 to end 56. The end 56 includes a first length 214 that extends from an intermediate portion 216 of the contact 46 at a position adjacent extension 200 at 90° relative to axis 212. A second length 218 is provided that extends from the first length 214 in the direction 210 of axis 212. With reference to FIG. 4, the body component 22 includes a recess 220. When the end 52 of the contact 46 is inserted into contact cavity 32 as described herein, a portion 222 of the length 214 will be inserted into the recess 220 and the length 218 will extend in the direction 58 of axis 60 of the body component 22 to the left of slot 102.

FIG. 11 illustrates contact 48 that extends in direction 224 of an axis 226 from end 52' to end 56'. The end 56' extends in direction 224 of axis 226 from extension 204 of intermediate portion 228. The intermediate portion 228 of contact 48 includes a recess 230. With reference to FIG. 4, when the end 52' of contact 48 is inserted into contact cavity 32' as described herein, the end 56' will extend from slot 102 in the direction 58 of axis 60 of the body component 22. End 56' will thereby be spaced from length 218 of end 56 since as noted length 218 extends in direction 58 at a location to the left of slot 102 (viewing FIG. 4). Although the length 214 of contact 56 is adjacent the intermediate portion 228 of contact 48, the length 214 will not engage intermediate portion 228 due to the presence of the recess 230 that will be disposed adjacent the length 214.

FIG. 12 illustrates contact 50 that extends in direction 232 of an axis 234 from end 52" to end 56". The end 56" extends in direction 232 from the edge of extension 206 of intermediate portion 236. With reference to FIG. 4, when the contact 50 is inserted into contact cavity 32" as described herein, the end 56" will extend from slot 104 in the direction 58 of axis 60 of the body connector 22. Since slot 104 is spaced from slot 102, end 56" of contact 50 will be spaced from end 56' of contact 48.

By structuring and arranging the contacts 46, 48, 50 and the corresponding contact cavities 32, 32', 32" in the foregoing manner, the contacts will not incur contact with each other. The depth to that the contacts 46, 48, 50 are inserted into respective contact cavities 32, 32', 32" may be controlled by providing each contact with one or more tabs 238 that engage respective detents that extend into contact cavities 32, 32', 32" from each cavity wall. For example, FIG. 2 illustrates a detent 240 extending into contact cavity 32" and engaged by a tab 238 of contact 50 thereby limiting the extent to that contact 50 may be inserted into cavity 32". Similar detents (not shown) extend into cavities 32 and 32' for engagement with tabs 238 of contacts 46 and 48, respectively.

The lamp socket of the present invention may be structured and arranged for a variety of filament focal lengths. In particular, the lamp socket of FIG. 1 can be fabricated to be compatible with varying filament focal lengths merely by varying the length of the body component 22 and the length of the contacts 46, 48, 50 during fabrication thereof. Without limitation, the lamp socket 20 illustrated in FIG. 1 can provide focal lengths of from about 20.85 mm to about 42.95 mm by altering such lengths during fabrication of the lamp socket to the extent required to effect the desired result.

Figure 13:
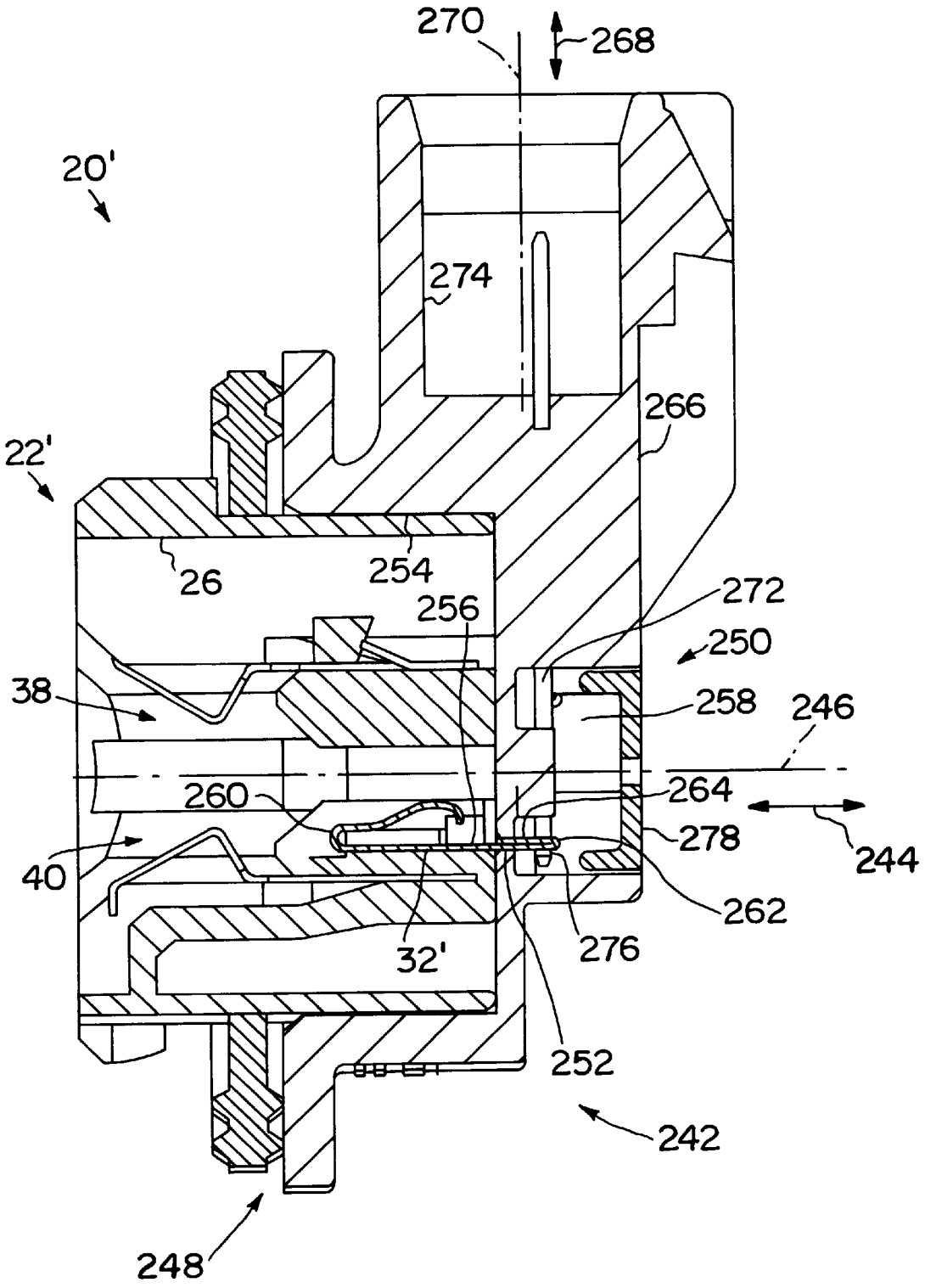
FIG. 13 is a cross sectional view of an alternative embodiment of the lamp socket of the present invention.

An alternative embodiment of the lamp socket of the present invention is illustrated in FIG. 13. In the embodiment of FIG. 13 a lamp socket 20' is provided that includes a body component 22' and resilient retention members 38, 40. Insofar as the features of the present invention are concerned, the body component 22' is somewhat smaller than the body component 22 of FIGS. 1 and 2 but is substantially identical thereto in other respects, and like elements are identified by like reference numbers.

In this embodiment, the housing component 242 extends in the direction 244 of an axis 246 from a housing front 248 to a housing rear 250 and includes at least one contact aperture 252 that extends from the housing cavity 254 to the housing rear. Although only one contact cavity, one contact aperture and one contact are illustrated, like the lamp socket 20 of FIGS. 1 and 2, body component 22' includes three contacts 256 each extending through a respective contact cavity 32, 32', 32" and a respective contact aperture 252. The housing component 242 includes a housing recess 258 intermediate the housing cavity 254 and the housing rear 250. Housing recess 258 is adjacent contact apertures 252. One end 260 of each contact 256 is structured and arranged for engagement with a lead wire of a lamp to be inserted into the cavity 26 of the body component 22'. An opposite end 262 of each contact 256 extends out of a respective contact aperture 252 and into housing recess 258. Each contact end 262 includes a first length 264 that extends into recess 258 from a contact aperture 252. In this embodiment, a contact shroud 266 similar to contact shroud 128 is provided that extends in a third direction 268 of a third axis 270, the third axis extending at an angle relative to a second axis 246 of the housing component 242. The contact end 262 includes a second length 272 that extends from the recess 258 into a shroud cavity 274 of the contact shroud 266. In the embodiment of FIG. 13, lengths 264 and 272 are separate parts that are attached at 276 in any conventional manner such as, for example, by soldering or welding. The recess 258 may be enclosed, and access made available thereto, by providing a detachable recess cover 278 at the housing rear 250. The embodiment of FIG. 13 provides a 90° lamp socket that achieves the objects of the present invention in those applications where such an angularly oriented lamp socket is required.

Fabrication of the lamp socket of the present invention may be accomplished using conventional procedures. For example, the contacts and resilient retention members may be stamped from a metal sheet and then rolled and/or bent as required to form the desired configuration. In the embodiment as illustrated in the drawings, the retention members are stainless steel and the contacts are brass. The body and housing components may be molded from a plastic material. For example the body component and housing component illustrated in the drawings are molded from PPA (polyphthalamide) and PBT (polybutylene terephthalate), respectively. The seal is molded from a thermoplastic elastomer.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

We claim:

1. A lamp socket, comprising:

first and second slidably engaging components including a body component and a housing component, said body component having a body cavity that includes opposing surfaces that include opposing angled ledges; said body component further comprising a plurality of contact cavities that extend therethrough; said housing component having a housing cavity matable with said body component, said housing component including at least one contact aperture extending therethrough;

first and second resilient retention members structured and arranged for insertion into said body cavity to slidably engage respective of said opposing angled ledges and to retain a base of a lamp; and a plurality of contacts, each contact structured and arranged for insertion into and slidably engage a respective contact cavity, each contact including a first end adapted to engage a lead wire of said lamp and an opposite second end adapted to extend through said at least one contact aperture.

2. The lamp socket of claim 1 wherein said first and second resilient retention members each comprises a pair of retention beams joined together by a common cross arm, each beam comprising a bearing surface adapted to engage an angled ledge in said body cavity.

3. The lamp socket of claim 1 wherein said body cavity of said body component comprises oppositely disposed latch members, and said first and second resilient retention members each comprise a mating latch member structured and arranged to slidably engage a respective latch member to lock a respective resilient retention member in said body component.

4. The lamp socket of claim 1 wherein said body component includes a locking member extending from an outer wall of said body component, and said housing component includes a mating locking member extending from an inner surface of said housing component, said locking component and mating locking components being slidably engaging to lock said body component and said housing component together.

5. The lamp socket of claim 1 wherein each contact cavity includes at least one slot, and each contact of said plurality of contacts includes a region between said first end and said second end that includes at least one extension, each extension slidably engaging a slot of said at least one slot.

6. The lamp socket of claim 5 wherein at least one extension of each contact is preloaded such that said preloaded extension is urged against a respective wall of a respective slot thereby effecting a reacting force through a respective contact to hold said respective contact in place when said contact is inserted into said contact cavity.

7. A lamp socket, comprising:

a body component extending in a first direction of a first axis from a body front to body rear, a first body cavity and a second body cavity extending into said body component from said body front towards said body rear and including a first body opening and an opposite second body opening, said first body opening and said second body opening including respectively a first pair of angled ledges extending in said first direction and an opposite second pair of angled ledges extending in said first direction; a first latch member within said first body opening between said first pair of angled ledges and a second latch member within said second body opening between said second pair of angled ledges, a plurality of contact cavities extending in said first direction from said body rear towards said body front;

a first pair of retention beams having a first bearing surface and a first mating latch member, said first pair of retention beams extending into said first body opening, said first pair of angled ledges engaging said first bearing surface and said first latch member engaging said first mating latch member, and a second pair of retention beams having a second bearing surface and a second mating latch member, said second pair of retention beams extending into said second body opening, said second pair of angled ledges engaging said second bearing surface and said second latch member engaging said second mating latch member, said first pair of retention beams and said second pair of retention beams being structured and arranged to retain a base of a lamp when said lamp is inserted into said body component at said body front;

a plurality of contacts, each contact of said plurality of contacts extending into a contact cavity of said plurality of contact cavities, a first end of each contact extending out of said body component at said body rear, and a second end of each contact facing said body front and being adapted for engagement with a respective lamp lead wire of a lamp when said lamp is inserted into said body component at said body front; and a housing component extending in a second direction of a second axis from a housing front to a housing rear, said housing component including a housing cavity, at least one contact aperture extending through said housing component from said housing rear to said housing cavity, said body component extending into said housing cavity at said body rear, said first end of each contact extending through a contact aperture and out of said housing component at said housing rear.

8. The lamp socket of claim 7 wherein said first end of each contact has a thickness that is greater than the thickness of said second end of each contact.

9. The lamp socket of claim 7 wherein said housing front includes a seamless flange surrounding said body component, and further comprising a flange seal adjacent said seamless flange.

10. The lamp socket of claim 7 wherein said body component further includes at least one locking member, and said housing component includes at least one mating locking member, said body component being attached to said housing component by engagement of said locking member with said mating locking member.

11. The lamp socket of claim 10 wherein each locking member comprises a flexible camming member extending from an outer wall of said body component, and each mating locking member comprises a mating camming member extending from an inner surface of said housing component.

12. The lamp socket of claim 7 wherein said body component includes an alignment member and said housing component includes a mating alignment member that engages said alignment member.

13. The lamp socket of claim 12 wherein said alignment member includes an elongated opening extending in an outer wall of said body component in said first direction from said body rear towards said body front, and said mating alignment member includes an elongated rib extending from an inner surface of said housing component in said second direction from said housing front towards said housing rear, said rib engaging said opening.

14. The lamp socket of claim 7 wherein said first pair of retention beams includes a first leg and a second leg joined together at one end by a first common cross bar and extending from said first common cross bar towards said body front, one end of said first leg and one end of said second leg comprising said first bearing surface, and wherein said second pair of retention beams includes a third leg and a fourth leg joined together at one end by a second common cross bar and extending from said second common cross bar towards said body front, one end of said third leg and one end of said fourth leg comprising said second bearing surface, opposite ends of said first and second legs structured and arranged to cooperate with respective opposite ends of said third and fourth legs to retain said base.

15. The lamp socket of claim 14 wherein said one end of said first leg and said second leg each comprise a respective first protuberance that engages a respective angled ledge of said first pair of angled ledges, and wherein said one end of said second leg and said third leg each comprise a respective second protuberance that engages a respective angled ledge of said second pair of angled ledges.

16. The lamp socket of claim 14 wherein said first common cross bar comprises said first mating latch member, and said second common cross bar comprises said second mating latch member.

17. The lamp socket of claim 16 wherein said first latch member comprises a first camming surface and said second latch member comprises a second camming surface, and further wherein said first mating latch member comprises a first mating camming surface and said second mating latch member comprises a second mating camming surface.

18. The lamp socket of claim 7 wherein each contact cavity of said plurality of contact cavities comprises one or more slots that extend in said first direction, and each contact comprises one or more extension positioned between said first end and said second end, said extension extending into a respective slot.

19. The lamp socket of claim 18 wherein at least one extension of each contact is preloaded such that said preloaded extension is urged against a respective wall of a respective slot thereby effecting a reacting force through a respective contact to hold said respective contact in place with said respective contact cavity.

20. The lamp socket of claim 7 wherein said housing component comprises a contact shroud extending away from said housing rear, said shroud comprising a seamless inner surface surrounding a shroud cavity, said seamless inner surface structured and arranged for sealing engagement with a mating connector.

21. The lamp socket of claim 20 wherein said contact shroud extends in said second direction and said first end of each contact extends into said shroud cavity.

22. The lamp socket of claim 20 wherein said contact shroud extends in a third direction of a third axis, said third axis extending at an angle relative to said second axis.

23. The lamp socket of claim 22 wherein said housing component comprises a housing recess intermediate said housing rear and said housing cavity and adjacent said at least one contact aperture, said first end of each contact including a first contact length extending into said housing recess and a second contact length extending from said housing recess into said shroud cavity.

24. The lamp socket of claim 23 wherein said housing recess is enclosed by a detachable recess cover at said housing rear, and further wherein each contact comprises two separate parts including said first length and said second length, said first length being attached to said second length in said housing recess.

* * * * *